US010605048B2

(12) United States Patent
MacGregor et al.

(10) Patent No.: US 10,605,048 B2
(45) Date of Patent: Mar. 31, 2020

(54) RISER PRESSURE RELIEF APPARATUS

(71) Applicant: MANAGED PRESSURE OPERATIONS PTE. LTD., Singapore (SG)

(72) Inventors: Alexander John MacGregor, Scotland (GB); Christian Leuchtenberg, Singapore (SG); Brian Piccolo, Singapore (SG); Henry Pinkstone, Singapore (SG); Bruce Garlick, Houston, TX (US)

(73) Assignee: MANAGED PRESSURE OPERATIONS PTE. LTD., Singepore (SG)

( * ) Notice: Subject to any disclaimer, the term of this patent is extended or adjusted under 35 U.S.C. 154(b) by 248 days.

(21) Appl. No.: 15/565,905

(22) PCT Filed: Apr. 13, 2016

(86) PCT No.: PCT/GB2016/051035

§ 371 (c)(1),
(2) Date: Oct. 12, 2017

(87) PCT Pub. No.: WO2016/166533

PCT Pub. Date: Oct. 20, 2016

(65) Prior Publication Data

US 2018/0051536 A1 Feb. 22, 2018

(30) Foreign Application Priority Data

Apr. 14, 2015 (GB) ..... 1506318.3

(51) Int. Cl.
*E21B 34/10* (2006.01)
*E21B 21/08* (2006.01)
(Continued)

(52) U.S. Cl.
CPC ..... *E21B 34/10* (2013.01); *E21B 21/08* (2013.01); *E21B 21/103* (2013.01);
(Continued)

(58) Field of Classification Search
CPC ..... E21B 34/10; E21B 21/08
See application file for complete search history.

(56) References Cited

U.S. PATENT DOCUMENTS 3,788,341 A 1/1974 Athy, Jr. et al.
3,992,889 A 11/1976 Watkins et al.
(Continued)

FOREIGN PATENT DOCUMENTS

GB 2 431 485 A 4/2007
WO WO 2010/069992 A2 6/2010
WO WO 2015/036137 A2 3/2015

*Primary Examiner* — Kristyn A Hall
(74) *Attorney, Agent, or Firm* — Norman B. Thot

(57) ABSTRACT

A riser pressure relief apparatus includes a pressure relief valve with a valve member, an actuator, and a pilot valve assembly connected to a pressurized fluid. The valve member moves between a first position, which prevents a fluid flow through the side port, and a second position, which permits the flow. The actuator includes an open port and moves the valve member from the first to the second position by supplying the pressurized fluid to the open port. The pilot valve assembly moves between a first configuration, which prevents a flow of the pressurized fluid to the open port, and a second configuration, which permits the flow. A valve part of the pilot valve assembly moves from a first to a second position based on a fluid pressure in the riser, which causes the pilot valve assembly to move from the first to the second configuration or vice versa.

27 Claims, 8 Drawing Sheets

(51) Int. Cl.

| | |
|---|---|
| ***E21B 21/10*** | (2006.01) |
| ***E21B 34/06*** | (2006.01) |
| ***E21B 34/14*** | (2006.01) |
| *E21B 34/00* | (2006.01) |

(52) U.S. Cl.
CPC ..... *E21B 34/066* (2013.01); *E21B 34/14* (2013.01); *E21B 2034/002* (2013.01)

(56) References Cited

U.S. PATENT DOCUMENTS

| | | | |
|---|---|---|---|
| 4,040,264 | A | 8/1977 | Neilon |
| 4,176,986 | A | 12/1979 | Taft et al. |
| 4,636,934 | A | 1/1987 | Schwendemann et al. |
| 8,893,803 | B1 | 11/2014 | Lugo |
| 2007/0095401 | A1 | 5/2007 | Webster |
| 2011/0098946 | A1 | 4/2011 | Curtiss, III |
| 2016/0215587 | A1 | 7/2016 | Vavik |

RISER PRESSURE RELIEF APPARATUS

CROSS REFERENCE TO PRIOR APPLICATIONS

This application is a U.S. National Phase application under 35 U.S.C. § 371 of International Application No. PCT/GB2016/051035, filed on Apr. 13, 2016 and which claims benefit to Great Britain Patent Application No. 1506318.3, filed on Apr. 14, 2015. The International Application was published in English on Oct. 20, 2016 as WO 2016/166533 A1 under PCT Article 21(2).

FIELD

The present invention relates to a pressure relief apparatus for use in relation to the drilling of a subterranean borehole for oil and/or gas production.

BACKGROUND

When drilling a subsea subterranean borehole for oil and/or gas production, it is known to use a tubular drill string which extends down from a drilling rig at the ocean surface into the borehole through a wellhead mounted at the ocean floor. The drill string has a drill bit mounted at its lowermost end and drilling may be achieved by rotating the drill string using a top drive mounted on the drilling rig, or by rotating the drill bit using a downhole motor at the remote end of the drill string. A tubular riser is mounted on a blowout preventer (BOP) provided at the top of the wellhead, and extends generally vertically upwardly to the ocean surface, whilst the drill string extends down the riser into the borehole.

During drilling, a fluid (known as drilling mud) is pumped down the inside of the tubular drill string, through the drill bit, and circulated continuously back to surface via the drilled space between the borehole and the drill string (referred to as the wellbore annulus), and between the riser and the drill string (referred to as the riser annulus). The riser thus provides a flow conduit for the drilling fluid and cuttings returns to be returned to the surface to the rig's fluid treatment system.

Deepwater drilling risers were traditionally designed as a conduit for transporting well bore returns to the rig during conventional drilling operations or for diverting returns overboard during conventional well control in the event of a shallow gas kick or an influx escaping past the subsea BOP. In such systems, the riser is designed as a flow conduit that is open to atmospheric pressure and is not a pressure containment system.

Since the development of riser flow control drilling systems, a drilling operation is now able to apply a safe amount of back pressure to the riser for the purposes of managed pressure drilling or reducing peak gas flow rates in a riser gas event. A riser flow control system consists of a pressure control manifold on the rig and a riser sealing device that diverts returns to the pressure control manifold. Where the riser is used in this way, there is a need to include a continuously available pressure relief system which provides an alternative flow path out of the riser for drilling returns so that the weakest link in the riser system is not over-pressured in the event of a control system failure, an operational error or a blockage in the conduit normally transporting riser returns to the rig.

Electrically operated pressure relief systems which use a PLC and pressure transducer to signal the actuator of the pressure relief valve have previously been described, and are disclosed, for example, in U.S. Pat. No. 4,636,934 and US 2011/0098946. In the event of an umbilical failure, or a failure of the electronic control system, the electrical communication required to operate such a system may be lost, and this can cause the system to be unavailable when needed or result in an unintended actuation (opening) of the pressure relief valve. An unintended actuation can cause an environmental hazard by diverting oil based drilling mud overboard unnecessarily (because there was no over-pressure event to begin with). Alternatively, a lack of system availability during a riser over-pressure event can cause the riser to burst through resulting in danger to the rig crew as well as an environmental hazard. To avoid this, the system must be provided with full redundancy, which involves providing multiple umbilicals, PLCs, pressure transducers, etc. at significant cost.

SUMMARY

An aspect of the present invention relates to providing an improved apparatus for automatically relieving excessive fluid pressure in the riser annulus in the event that the pressure of fluid in the riser exceeds a predetermined amount.

In an embodiment, the present invention provides a riser pressure relief apparatus which includes a tubular riser and a pressure relief valve. The tubular body comprises a main body which is configured to enclose a main passage, and a side port which is configured to extend through the main body to connect the main passage with an exterior of the tubular riser. The pressure relief valve includes a valve member, an actuator, a source of a pressurized fluid, and a pilot valve assembly connected to the source of the pressurized fluid. The valve member is configured to move between a first position in which the valve member substantially prevents a flow of a fluid through the side port, and a second position in which the flow of the fluid through the side port is permitted. The actuator comprises an open port. The actuator is configured to move the valve member from the first position to the second position by the supply of the pressurized fluid to the open port. The pilot valve assembly is movable between a first configuration in which a flow of the pressurized fluid from the source of the pressurized fluid to the open port of the actuator is substantially prevented, and a second configuration in which the flow of the pressurized fluid from the source of the pressurized fluid to the open port of the actuator is permitted. The pilot valve assembly comprises a valve part which is fluidly connected to the main passage of the tubular riser. The valve part is configured to move from a first position to a second position when a fluid pressure in the main passage of the tubular riser exceeds a predetermined amount. A movement of the valve part from the first position to the second position causes the pilot valve assembly to move either from the first configuration to the second configuration or from the second configuration to the first configuration.

BRIEF DESCRIPTION OF THE DRAWINGS

The present invention is described in greater detail below on the basis of embodiments and of the drawings in which.

DETAILED DESCRIPTION

Figure 1:
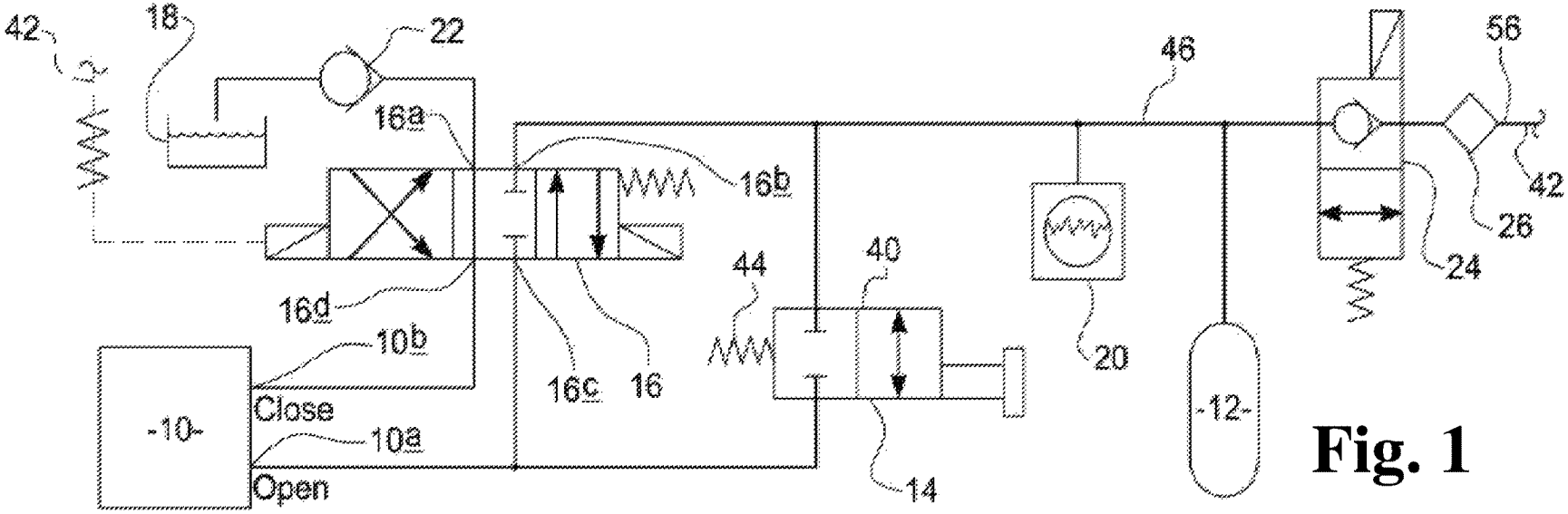
FIG. 1 shows a schematic illustration of a first embodiment of a riser pressure relief apparatus according to the present invention in the normal closed position.

In an embodiment, the present invention provides a riser pressure relief apparatus comprising a tubular riser having a main body enclosing a main passage and a side port extending through the main body to connect the main passage with the exterior of the riser, a pressure relief valve including a valve member which is movable between a first position in which the valve member substantially prevents flow of fluid through the side port and a second position in which flow of fluid through the side port is permitted, an actuator which is operable to move the valve member from the first position to the second position by the supply of pressurized fluid to an open port of the actuator, a source of pressurized fluid, and a pilot valve assembly, the pilot valve assembly being connected to the source of pressurized fluid and being movable between a first configuration in which flow of fluid from the source of pressurized fluid to open port of the actuator is substantially prevented and a second configuration in which flow of fluid from the source of pressurized fluid to the open port of the actuator is permitted, wherein the pilot valve assembly includes a valve part which is fluidly connected to the main passage of the riser and moves from a first position to a second position when the fluid pressure in the main passage of the riser exceeds a predetermined amount, movement of the valve part from the first position to the second position causing the pilot valve assembly to move from the first configuration to the second configuration, or vice versa, i.e., in the alternative, movement of the valve part from the first position to the second position causing the pilot valve assembly to move from the second configuration to the first configuration.

Advantageously, movement of the valve part from the first position to the second position causes the pilot valve assembly to move from the first configuration to the second configuration.

In an embodiment, the valve member of the pressure relief valve can, for example, be rotatable between the first position and the second position.

In an embodiment, the pressure relief valve can, for example, be a ball valve.

In an embodiment, the actuator can, for example, be configured so that the valve member of the pressure relief valve is movable from the second position to the first position by the supply of pressurized fluid to a close port of the actuator. In this case, the actuator may be configured so that, if the fluid pressure at the open port exceeds the fluid pressure at the close port by a predetermined amount, the actuator moves the valve member from the first position to the second position, whilst if the fluid pressure at the close port exceeds the fluid pressure at the open port by a predetermined amount, the actuator moves the valve member from the second position to the first position.

In an embodiment, the source of pressurized fluid can, for example, be an accumulator bottle.

In an embodiment, the source of pressurized fluid and pilot valve can, for example, be provided adjacent to the pressure relief valve.

In an embodiment, the source of pressurized fluid and pilot valve can, for example, be provided downstream of a connector, whereby the source of pressurized fluid may be connected to an umbilical. In the event of an umbilical failure, the pilot valve and source of pressurized fluid are therefore available to operate the pressure relief valve.

In an embodiment, the fluid in the source of pressurized fluid can, for example, be hydraulic fluid.

In an embodiment, the valve part of the pilot valve assembly can, for example, be a piston which has a face which is exposed to the fluid pressure in the main passage of the riser.

In an embodiment, the pilot valve assembly can, for example, be provided with a resilient biasing element which exerts a force on the valve part urging it into the first position.

In an embodiment, the source of pressurized fluid can, for example, be a local source of pressurized fluid and the pressure relief apparatus further comprises a fluid flow line for connection to a remote source of pressurized fluid. In this case, the fluid flow line may extend to the local source of pressurized fluid.

There may be a non-return valve provided in the fluid flow line, the non-return valve being operable to permit flow of fluid along the fluid flow line towards the local source of pressurized fluid whilst preventing flow of fluid along the fluid flow line in the opposite direction.

The pilot valve assembly may include a control inlet for an external control signal, and be operable to move from the first configuration to the second configuration when the valve part is on the first position on receipt of an external control signal at the control inlet.

The control inlet may be for an electrical control signal or for a fluid pressure control signal.

The pilot valve assembly may include a pilot valve having the valve part.

The pilot valve assembly may include a control valve which moves from a rest position in which flow of fluid from the source of pressurized fluid to the open port of the actuator is substantially prevented to an active position in which flow of fluid from the source of pressurized fluid to the open port of the actuator is permitted on receipt of the external control signal.

The control valve may be provided with a first port which is connected to the source of pressurized fluid via a flow line which does not contain the pilot valve, and a second port which is connected to the open chamber via a flow line which does not contain the pilot valve, and a valve member which is movable between a first position in which flow of fluid between the first port and the second port is permitted, and a second position in which flow of fluid between the first port and the second port is substantially prevented.

The control valve may be provided with an electrically operable actuator which moves the control valve from its rest position to its open position when an electrical control signal is supplied to the actuator.

Alternatively, the control valve may be a pilot operated valve with an actuator to which the control inlet is connected, the control valve being configured so that it moves from its rest position to its active position when the fluid pressure at the control inlet exceeds a predetermined level.

The control valve may be operable to connect the open chamber of the actuator to a low pressure region.

The control valve may connect the open chamber of the actuator to a low pressure region when the control valve is in its rest position.

The actuator may be configured so that the valve member of the pressure relief valve is movable from the second position to the first position by the supply of pressurized fluid to a close port of the actuator.

The actuator may be configured so that, if the fluid pressure at the open port exceeds the fluid pressure at the close port by a predetermined amount, the actuator moves the valve member from the first position to the second position, whilst if the fluid pressure at the close port exceeds the fluid pressure at the open port by a predetermined amount, the actuator moves the valve member from the second position to the first position.

The pilot valve assembly may be configured to allow a flow of fluid from the source of pressurized fluid to the close port, and to connect the open port of the actuator to a low pressure region when the pilot valve assembly is in the first configuration.

The control valve may be movable to a close position in which the close port of the actuator is connected to the source of pressurized fluid whilst the open port of the actuator is connected to a low pressure region.

The control valve may be provided with an electrically operable actuator which moves it from its rest position to its close position when electrical power is supplied to the actuator.

Embodiments of the present invention are described, by way of example only, under reference to the accompanying drawings.

The drawings illustrate embodiments of riser pressure relief apparatus which are intended to be used in connection with a tubular riser 1 for use in drilling a subsea wellbore for oil and/or gas production. The riser 1 has a main body 2 enclosing a main passage 4, and a side port extending through the main body 2 to connect the main passage 4 to the exterior of the riser 1.

Referring now to FIG. 1, there is shown a schematic illustration of a first embodiment of riser pressure relief apparatus in a normal closed position. The pressure relief apparatus includes a pressure relief valve 10 which is, in use, mounted on the riser 1, and which is a valve member which is movable between a first position in which the valve member substantially prevents flow of fluid through the side port 6, and a second position in which flow of fluid through the side port 6 is permitted. The pressure relief valve 10 may be mounted directly on the riser 1, or in a fluid flow passage which extends from the side port 6. The pressure relief valve 10 further includes an actuator which is operable to move the valve member from the first position to the second position by the supply of pressurized fluid to an open port 10*a* in the actuator.

In an embodiment, the valve can, for example, rotate between the first position and second position.

In an embodiment of the present invention, the valve member 48 of the pressure relief valve 10 can, for example, be a ball valve 54. It should be appreciated, however, that any other suitable configuration of valve could be used.

The pressure relief apparatus further includes a source of pressurized fluid for supply to the open port 10*a* of the pressure relief valve 10. In this embodiment of the present invention, the source of pressurized fluid is an accumulator bottle 12, but may equally be any other form of pressure vessel. Advantageously, the accumulator bottle 12 is located as close as possible to the actuator of the pressure relief valve 10 to minimize the response time of the pressure relief valve 10.

The accumulator bottle 12 is connected to the open port 10*a* of the pressure relief valve 10 via a pressure operated spring biased pilot valve 14. The pilot valve 14 includes a resilient biasing element (spring) 44 which biases the pilot valve 14 to a closed position in which flow of fluid from the accumulator bottle 12 to the open port 10*a* of the pressure relief valve 10. The pilot valve 14 is movable against the biasing force of the spring 44 to an open position in which the accumulator bottle 12 is connected to the open port 10*a* of the pressure relief valve actuator. The pilot valve 14 has an actuator with a face 52 which is, in use, in pressure communication with the fluid in the main passage 4 of the riser 1, the fluid pressure in the riser 1 acting to urge the actuator against the biasing force of the spring 44. When the fluid pressure in the riser 1 exceeds a predetermined value, the actuator can overcome the biasing force of the spring 44 to move the pilot valve 14 to the open position. In an embodiment of the present invention, the actuator comprises a piston valve as the valve part 40 movably mounted in a cylinder. As set forth above, the source of pressurized fluid (i.e, the accumulator bottle 12) and the pilot valve 14 can, for example, be provided downstream of a connector 56, whereby the source of pressurized fluid may be connected to an umbilical 42. The source of pressurized fluid can, for example, be a local source of pressurized fluid and the pressure relief apparatus can further comprise a fluid flow line 46 for connection to a remote source of pressurized fluid. In this case, the fluid flow line 46 may extend to the local source of pressurized fluid. There may be a non-return valve provided in the fluid flow line 46, the non-return valve being operable to permit flow of fluid along the fluid flow line 46 towards the local source of pressurized fluid whilst preventing flow of fluid along the fluid flow line 46 in the opposite direction.

The resilient biasing element 44 may comprise a replaceable spring cartridge, and so the pressure at which the pilot valve 14 moves from the closed position to the open position may be adjusted by replacing the spring cartridge with a spring rated to withstand the desired pressure before compressing.

The pressure relief system is also provided with a control valve 16. The control valve 16 is a three position valve which has a first port 16*a* which is connected to a fluid reservoir 18, a second port 16*b* which is connected to a line to the accumulator bottle 12, a third port 16*c* which is connected to the line between the pilot valve 14 and the open port 10*a* of the pressure relief valve actuator, and a fourth port 16*d* which is connected to the close port 10*b* of the pressure relief valve actuator 10. The fluid reservoir 18 may be a tank located at surface. Alternatively, the first port 16*a* may simply vent into the sea.

The control valve 16 is biased to a rest position in which the second port 16*b* and third port 16*c* are closed, whilst the first port 16*a* is connected to the fourth port 16*d*. As such, when the control valve 16 is in the rest position, the close port 10*b* of the pressure relief valve actuator 10 is connected to the fluid reservoir 18.

Whilst the control valve 16 may be hydraulically (or pilot) operated, in this embodiment, it is an electrically operated valve. The control valve 16 is provided with a first electrically operated actuator such as a solenoid or piezoelectric element which, when charged, moves the control valve 16 from the rest position to an open position in which the second port 16*b* is connected to the third port 16*c*, and the first port 16*a* is connected to the fourth port 16*d*. As such, when the control valve 16 is in the open position the close port 10*b* of the pressure relief valve 10 is connected to the fluid reservoir 18 whilst the open port 10*a* is connected to the accumulator bottle 12. The control valve 16 is also provided with a second electrically operated actuator, such as a solenoid or piezoelectric element which, when charged, moves the control valve 16 from the rest configuration to an close position in which the first port 16*a* is connected to the third port 16*c* and the second port 16*b* is connected to the fourth port 16*d*. As such, when the control valve 16 is in the close position, the close port 10*b* of the pressure relief valve actuator is connected to the accumulator bottle 12 whilst the open port 10*a* is connected to the fluid reservoir 18.

In this example, a pressure transducer 20 is provided to measure the fluid pressure in the line between the accumulator bottle 12 and the pilot valve 14. This may be used for monitoring of the system pressure, and periodic system integrity checks. It will be appreciated, however, that the pressure relief valve 10 can be actuated without the availability of pressure transducers.

In this example, a non-return valve 22 is provided in the line between the fluid reservoir 18 and the first port 16*a* of the control valve 16.

Pressurized fluid is supplied to the accumulator bottle 12 by an umbilical 42 connection to a fluid pump, which is typically mounted on the drilling rig. A further non-return valve 24 is provided in the umbilical 42 (or a line connecting the accumulator bottle 12 to the umbilical 42). This is intended to prevent the back flow of fluid from the accumulator bottle 12 in the event that the umbilical 42 is damaged and loses pressure. As a result, the pressure relief apparatus does not loose pressure, and continues to function in the event of an umbilical failure.

In this example, the further non-return valve 24 is provided which is an electrically operated 2 position valve which is movable between a first position in which flow of fluid from the accumulator bottle 12 to the umbilical 42 is substantially prevented whilst flow of fluid from the umbilical 42 to the accumulator bottle is permitted, and a second position in which flow of fluid is permitted in both those directions. The non-return valve 24 will normally be in its first position, but may be moved to its second position in order to de-pressurize the pressure relief valve system before retrieving it from under the sea.

The system may be provided with a filter 26 in the feed line from the umbilical 42 into the accumulator bottle 12 to ensure the cleanliness of the fluid entering the control system.

The pressure relief apparatus operates as follows.

Normally, the pressure relief apparatus is configured as illustrated in FIG. 1. The pilot valve 14 is in the closed position, and the control valve 16 is in the rest position. As such, the line to the open port 10*a* of the pressure relief valve 10 is closed, and the close port 10*b* is connected to the reservoir 18.

Figure 2:
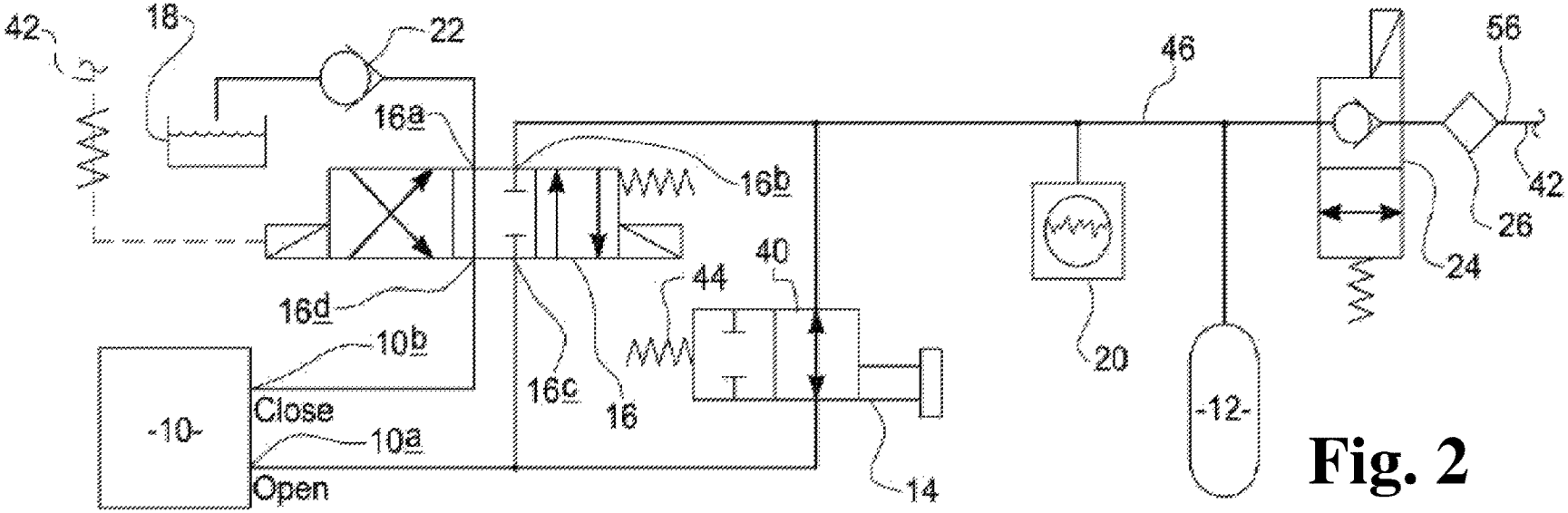
FIG. 2 shows a schematic illustration of the embodiment of the riser pressure relief apparatus illustrated in FIG. 1 in the automatic open position.

If the fluid pressure in the riser 1 exceeds the predetermined level, the pilot valve 14 moves to the open position, whilst the control valve 16 is maintained in its rest position, as illustrated in FIG. 2. Fluid flows from the accumulator bottle 12 through the pilot valve 14 to the open port 10*a* of the pressure relief valve 10, and causes the actuator to move the pressure relief valve 10 from the closed position to the open position. The fluid pressure in the riser 1 may then be relieved by the flow of fluid out of the riser 1 through the side port 6. Fluid flowing through the side port 6 is typically vented to a safe location away from the drilling rig. Fluid is typically vented overboard via port or starboard diverter lines as done with traditional overboard lines. Another option would be to route the flow to a mud gas separator on the drilling rig.

When the pressure in the riser 1 drops to below the predetermined level, the pilot valve 14 returns to its closed position. The open port 10*a* is therefore closed, with the fluid pressure from the accumulator bottle 12 maintained within the actuator. The pressure relief valve 10 therefore remains in its open position.

Figure 3:
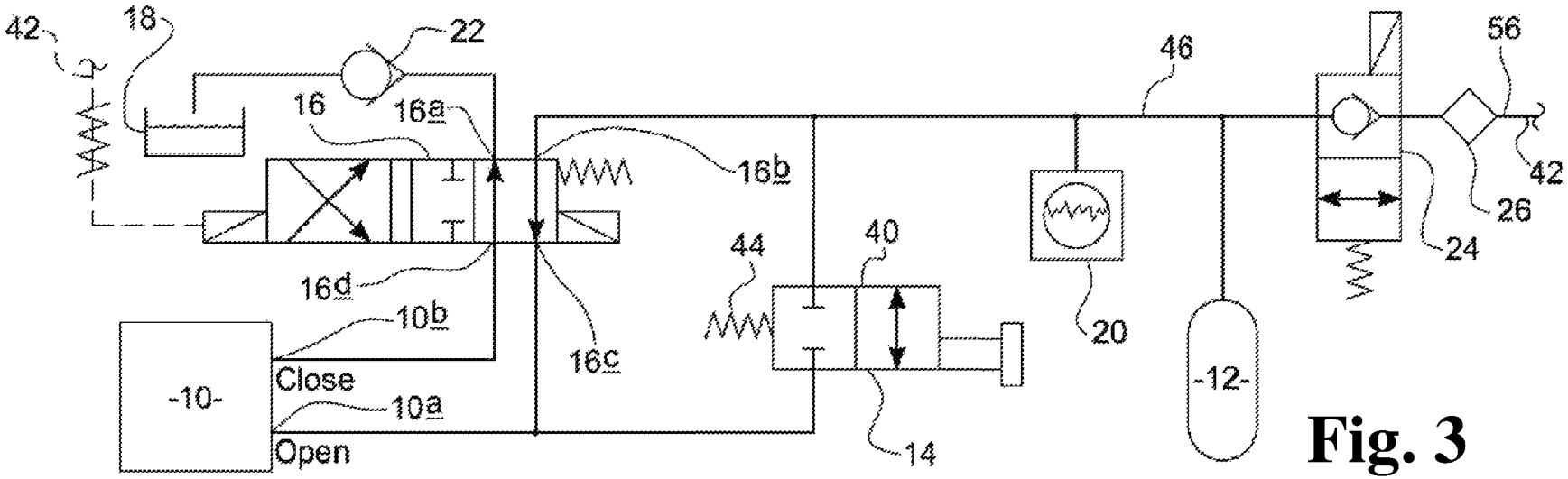
FIG. 3 shows a schematic illustration of the embodiment of a riser pressure relief apparatus illustrated in FIG. 1 in the electronically initiated open position.

The pressure relief valve 10 may also be opened by a user even if the pressure in the riser 1 has not exceeded the predetermined level required to move the piston actuator of the pilot valve 14. To achieve this, electrical power is supplied to the first electrically operated actuator of the control valve 16 to move the control valve 16 to its open position in which the close port 10*b* of the pressure relief valve 10 remains connected to the reservoir 18 whilst the open port 10*a* is connected to the accumulator bottle 12 via the control valve 16. This is illustrated in FIG. 3. Pressurized fluid from the accumulator bottle 12 thus flows to the open port 10*a* and operates the actuator to open the pressure relief valve 10.

Figure 4:
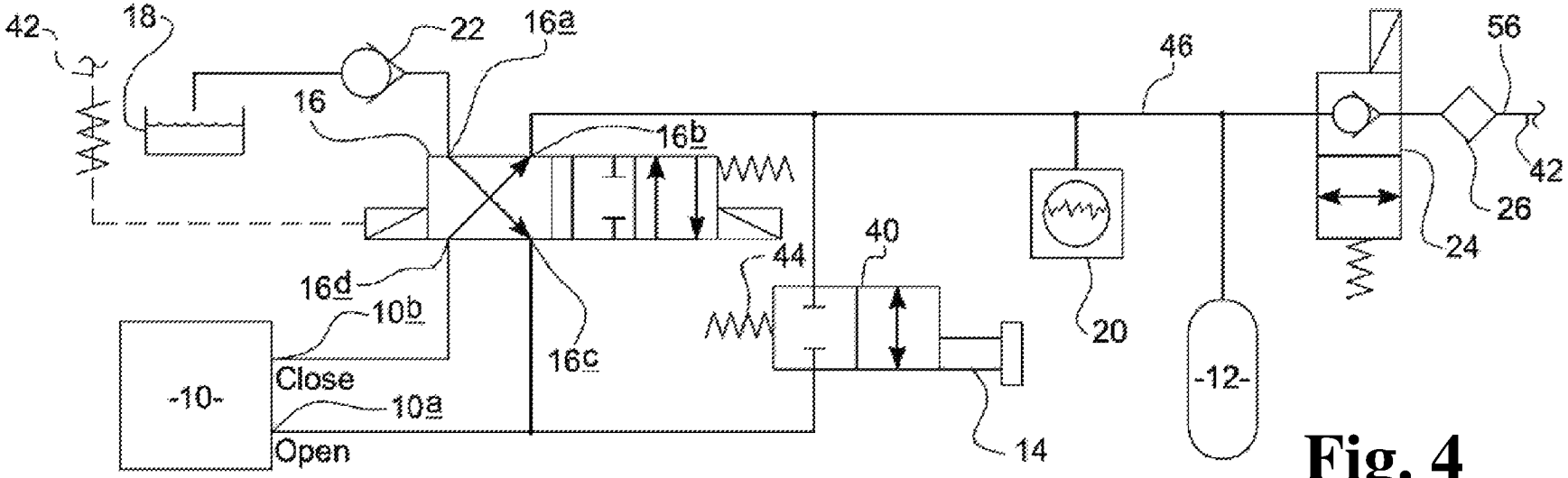
FIG. 4 shows a schematic illustration of the embodiment of the riser pressure relief apparatus illustrated in FIG. 1 in the return to close position.

In order to close the pressure relief valve 10 after either automatic operation in an overpressure event, or after electronic opening using control valve 16, it is necessary to energize the control valve 16, by supply of power to the second electrically operated actuator, to move it to the close position, as illustrated in FIG. 4. The open port 10*a* of the pressure relief valve 10 is connected to the reservoir 18, thus relieving the fluid pressure at the open port 10*a*, whilst the close port 10*b* is connected to the accumulator bottle 12. The supply of pressurised fluid from the accumulator bottle 12 to the close port 10*b* of the pressure relief valve 10 operates the actuator to move the pressure relief valve 10 to the closed position, thus sealing the riser 1 once more. Once the pressure relief valve 10 is closed, the supply of electrical power to the control valve 16 can cease, so that the control valve 16 returns to its rest position.

Figure 5:
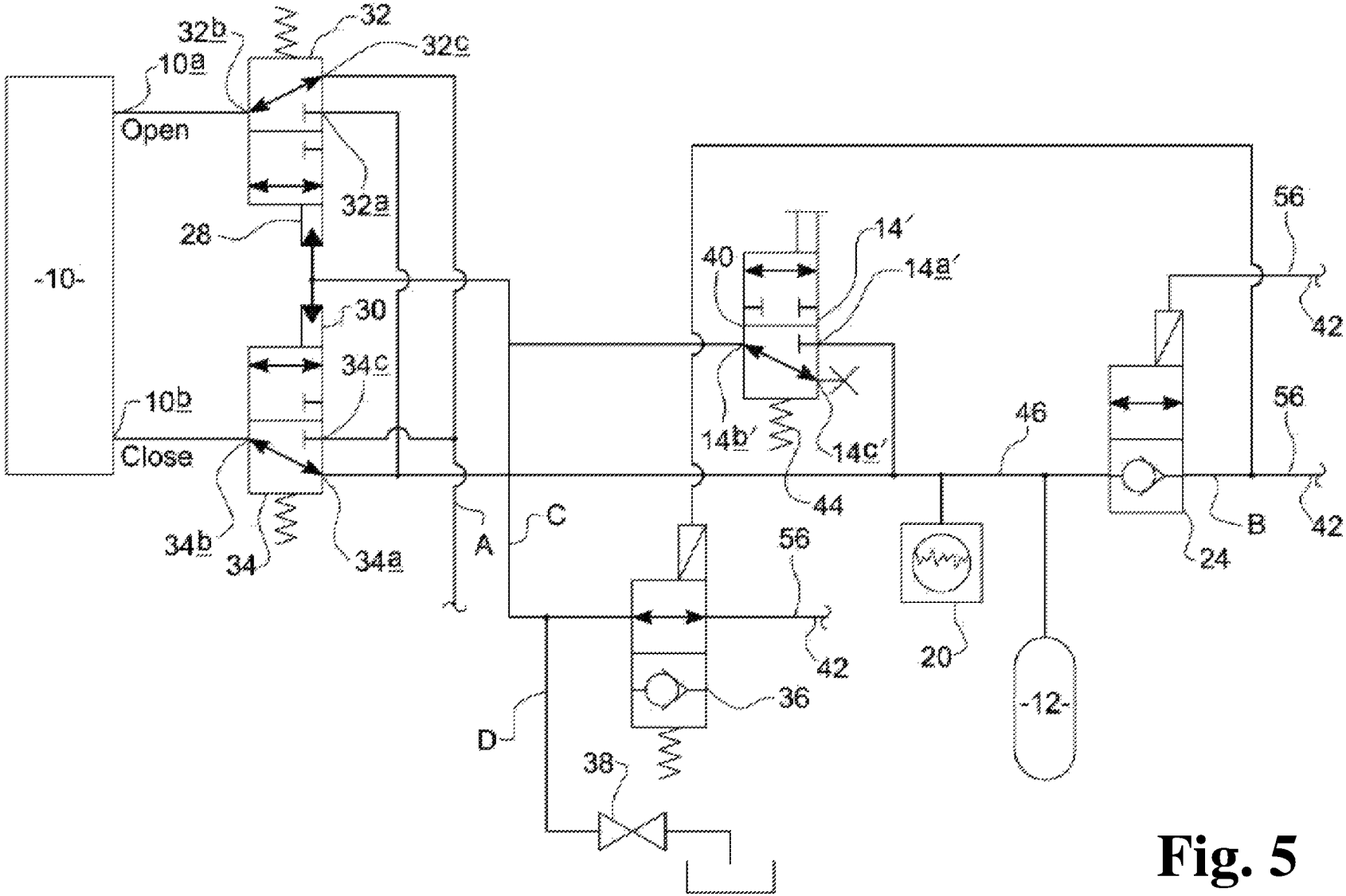
FIG. 5 shows a schematic illustration of a second, alternative embodiment of a riser pressure relief apparatus according to the present invention in the normal closed configuration.
Figure 6:
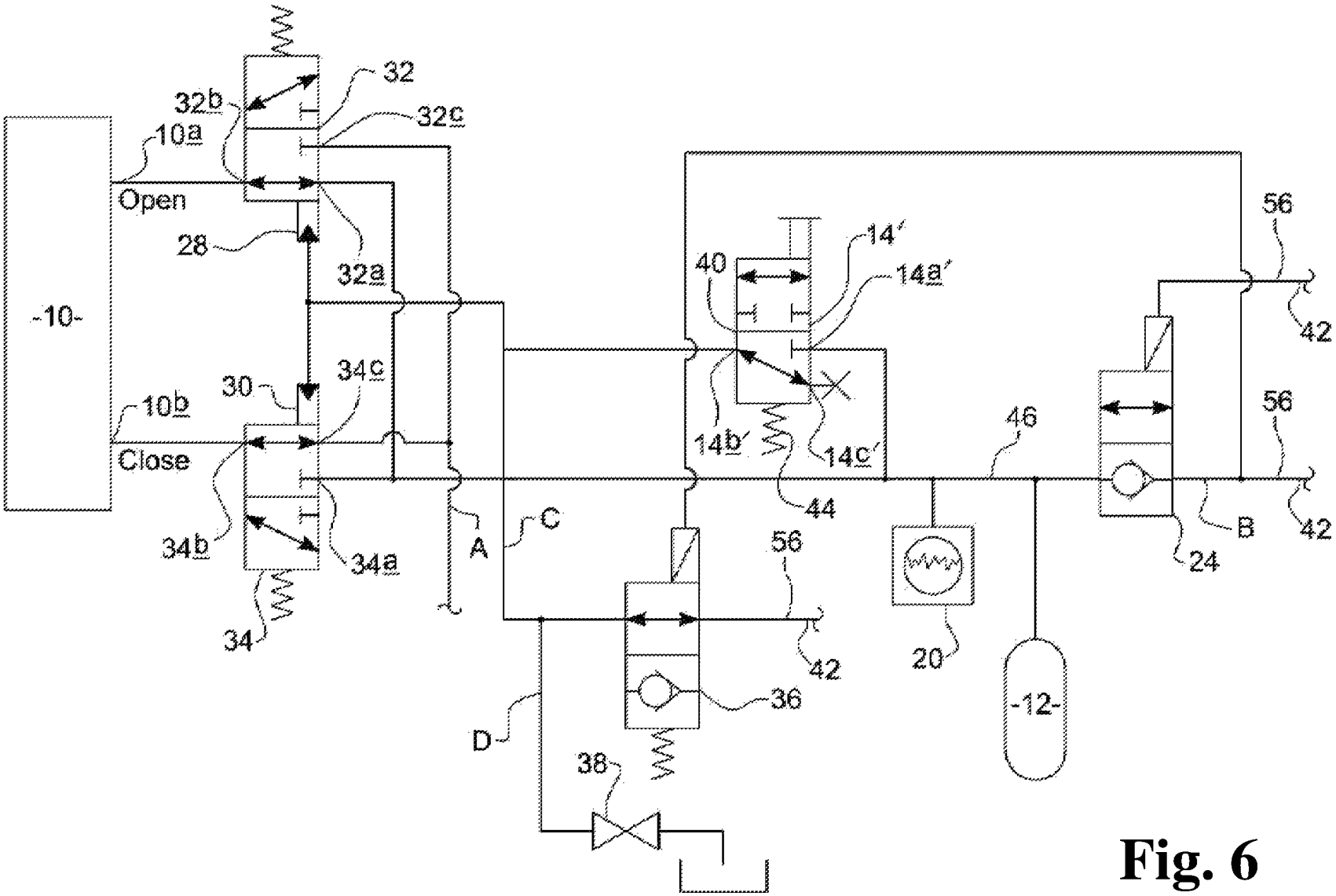
FIG. 6 shows a schematic illustration of the embodiment of the riser pressure relief apparatus illustrated in FIG. 5 in the open position under surface control.

An alternative embodiment of pressure relief apparatus is illustrated in FIGS. 5 and 6.

This embodiment of pressure relief apparatus has many features in common with the pressure relief apparatus illustrated in FIGS. 1 to 4, and the same reference numerals have been used in relation to these common parts. The information set out in the description relating to FIGS. 1 to 4 about these common parts applies equally to the equivalent parts in the embodiment illustrated in FIGS. 5 and 6.

The pressure relief apparatus illustrated in FIGS. 5 and 6 includes a pressure relief valve 10 which is, in use, mounted on the riser 1, and which is a valve member 48 which is movable between a first position in which the valve member 48 substantially prevents flow of fluid through the side port 6 and a second position in which flow of fluid through the side port 6 is permitted. The pressure relief valve 10 further includes an actuator which is operable to move the valve member 48 from the first position to the second position by the supply of pressurized fluid to an open port 10*a* in the actuator.

Figure 10:
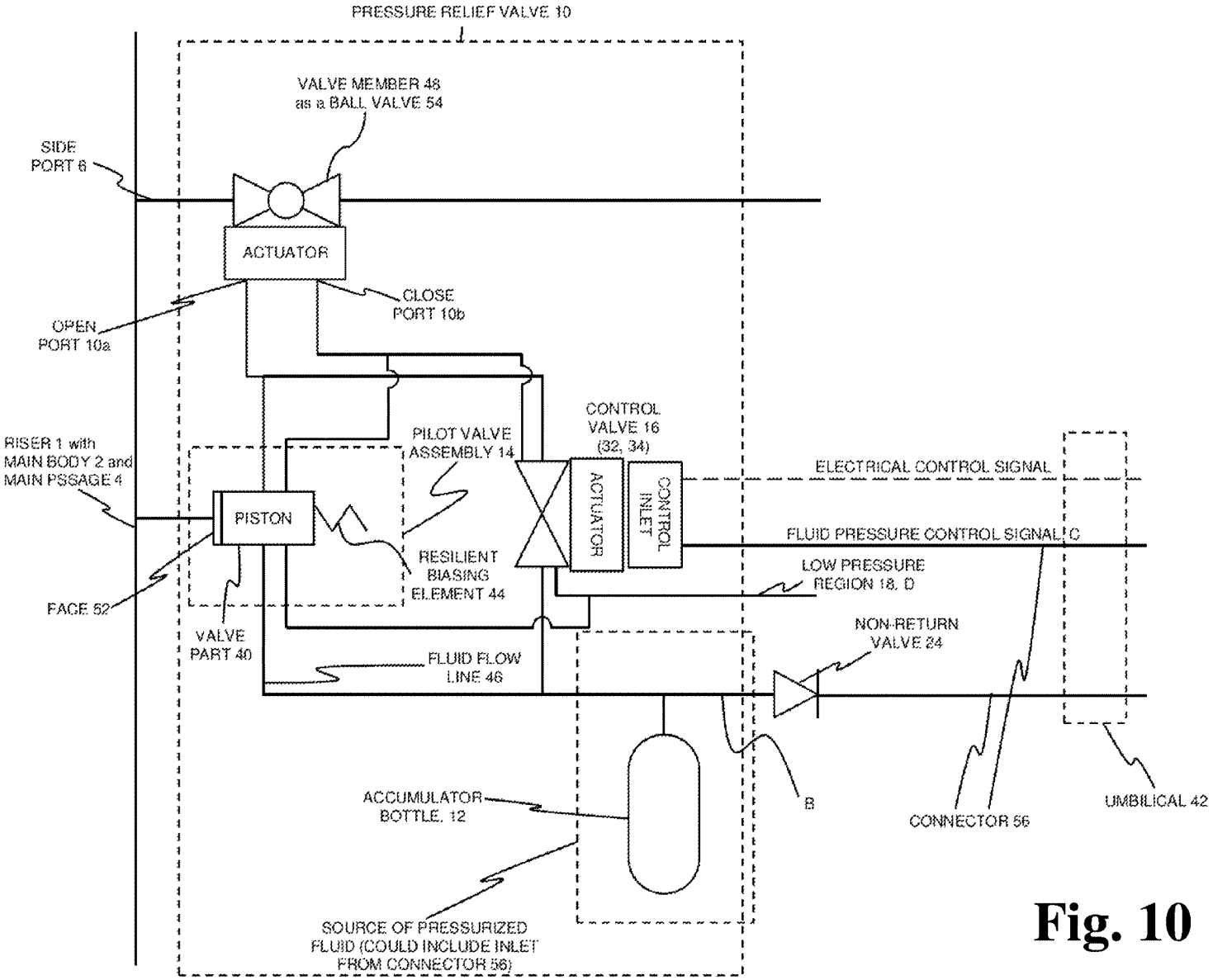
FIG. 10 shows a schematic illustration of an embodiment of the riser pressure relief apparatus connected to a riser with a main body and a main passage where the valve part of the pilot valve assembly is provided as a piston valve.

The pressure relief apparatus further includes a source of pressurized fluid for supply to the open port of the pressure relief valve, which, in this embodiment of the present invention, is an accumulator bottle 12. The pressure relief system also includes a pressure operated spring biased pilot valve 14' with a resilient biasing element (spring) 44 which biases the pilot valve 14' to a closed position. The pilot valve 14' has a piston actuator as the valve part 40, the piston actuator having a face 52 which is, in use, in pressure communication with the fluid in the main passage 4 of the riser 1, the fluid pressure in the riser 1 acting to urge the piston against the biasing force of the spring 44. See FIG. 10. When the fluid pressure in the riser 1 exceeds a predetermined value, the piston actuator can overcome the biasing force of the spring 44 to move the pilot valve 14' to an open position.

The configuration of the pilot valve 14' is, however, slightly different to the configuration of the pilot valve 14 in the embodiment of the present invention described in relation to FIGS. 1 to 4. Specifically, the pilot valve 14' has a first port 14*a*' which is connected to the accumulator bottle 12, a second port 14*b*' which is connected to the control actuators 28, 30 of two 2 position 3 way pilot operated valves 32, 34 (hereinafter referred to as the auxiliary pilot valves 32, 34), and a third port 14*c*' which is blocked. When the pilot valve 14' is in the closed position, the first port 14*a*' is closed whilst the second port 14*b*' is connected to the third port 14*c*'. When the pilot valve 14' is in the open position, the first port 14*a*' is connected to the second port 14*b*', and the third port 14*c*' is closed.

The auxiliary pilot valves 32, 34 are each biased to a rest position by a resilient biasing element, such as a spring, and are movable from the rest position to an active position by the supply of pressurized fluid to their respective actuator 28, 30. The auxiliary pilot valves 32, 34 each have a first port 32*a*, 34*a* which is connected to the accumulator bottle 12, a second port 32*b*, 34*b* which is connected to the actuator of the pressure relief valve 10, and a third port 32*c*, 34*c* which is connected to a drain line A which extends to either a pressurized fluid reservoir via the umbilical 42, or to an overboard vent point. The second port 32*b* of the first auxiliary pilot valve 32 is connected to the open port 10*a* of the pressure relief valve actuator, whilst the second port 34*b* of the second auxiliary pilot valve 34 is connected to the close port 10*b* of the pressure relief valve actuator.

When the first auxiliary pilot valve 32 is in the rest position, the third port 32*c* is connected to the second port 32*b* whilst the first port 32*a* is closed, whilst when it is in the active position, the first port 32*a* is connected to the second port 32*b*, and the third port 32*c* is closed. In contrast, when the second auxiliary pilot valve 34 is in the rest position, the first port 34*a* is connected to the second port 34*b* whilst the third port 34*c* is closed, whilst when it is in the active position, the first port 32*a* is closed and the third port 34*c* is connected to the second port 34*b*.

In this example, a pressure transducer 20 is provided to measure the fluid pressure in the line between the accumulator bottle 12 and the pilot valve 14'.

Pressurized fluid is supplied to the accumulator bottle 12 by an umbilical connection to a source of high pressure fluid, typically a fluid pump, which is mounted on the drilling rig. A non-return valve 24 is provided in the line B connecting the accumulator bottle 12 to the high pressure line of the umbilical 42. This is intended to prevent the back flow of fluid from the accumulator bottle 12 in the event that the umbilical 42 is damaged and loses pressure. As a result, the pressure relief apparatus does not lose pressure, and continues to function, in the event of an umbilical failure.

In this example, the non-return valve 24 is a pilot operated 2 position valve which is movable between a first position in which flow of fluid from the accumulator bottle 12 to the umbilical 42 is substantially prevented whilst flow of fluid from the umbilical 42 to the accumulator bottle 12 is permitted, and a second position in which flow of fluid is permitted in both those directions. This non-return valve 24 is normally in the first position, but it includes a fluid pressure operated actuator and may be moved from the first position to the second position by the supply of pressurized fluid to the actuator to de-pressurize the system prior to its retrieval from beneath the sea. It will be appreciated, however, that this valve 24' could equally be electrically operated.

As with the embodiment of the present invention described in relation to FIGS. 1 to 4, the system may be provided with a filter in the feed line from the umbilical 42 into the accumulator bottle 12 to provide the cleanliness of the fluid entering the control system.

The line between the actuators 28, 30 of the auxiliary pilot valves 32, 34 and the second port 14*b*' of the pilot valve 14' is also connected to a control line C via a further non-return valve 36. The control line C is connected to a surface control line in the umbilical 42. The further non-return valve 36 is a pilot operated 2 position valve which is movable between a first position in which flow of fluid along the control line from the line between the actuators 28, 30 and the pilot valve 14' to the umbilical 42 is substantially prevented whilst flow of fluid along the control line from the umbilical 42 to the line between the actuators 28, 30 and the pilot valve 14' is permitted, and a second position in which flow of fluid is permitted in both those directions.

The pilot non-return valve 36 has an actuator which is connected to the line B from the umbilical 42 to the accumulator bottle 12 upstream of the non-return valve 24 (i.e., between the non-return valve 24 and the connection to the umbilical 42). The pilot non-return valve 36 includes a resilient biasing element which biases it to the first position. Its actuator is configured so that when the pressurized fluid is supplied to the actuator of the pilot non-return valve 36, i.e., when the line from the umbilical 42 to the accumulator bottle 12 is pressurized, the pilot non-return valve 36 is maintained in its second position (two way flow permitted), and returns to its first position when the fluid pressure in the line from the umbilical 42 to the accumulator bottle 12 falls to a level which is insufficient to overcome the biasing force of the resilient biasing element.

A pressure release line D connects the control line C to a fluid reservoir (or other low pressure region) via an ROV-operable drain valve 38. This drain valve 38 is normally closed to contain fluid in the control line C, but may be opened by an ROV to allow flow of fluid from the control line C to the fluid reservoir.

The embodiment of pressure relief apparatus illustrated in FIGS. 5 and 6 may be operated as follows.

The pressure relief apparatus is normally configured as illustrated in FIG. 5. The actuator of the umbilical non-return valve 24 is not pressurized so this valve is in its first position, and therefore permits flow in one direction only. The pilot valve 14 is in the closed position, and as such the lines to the actuators 28, 30 of the auxiliary pilot valves 32, 34 are closed at the pilot valve 14'. Whilst the connection between line B and the high pressure line in the umbilical 42 is present, the further non-return valve is in its second position (two way flow), as illustrated in FIG. 5. If, however, the connection to the umbilical 42 is damaged or lost with the result that the supply of high pressure fluid to line B is lost, the further non-return valve 36 will move to its first position. In either case, as the control line C is not pressurized, there is no supply of pressurized fluid to the actuators 28, 30 of the auxiliary pilot valves 32, 34. As a result, the auxiliary pilot valves 32, 34 are in their rest positions, and the open port 10*a* of the pressure relief valve actuator is connected to the drain line A by the first auxiliary pilot valve 32 and the close port 10*b* of the pressure relief valve actuator is connected to the accumulator 12 via the second auxiliary pilot valve 34. The pressure relief valve 10 is therefore in its closed position.

Surface control of the pressure relief valve 10 via the umbilical 42, in the absence of excess pressure in the riser 1, can be achieved as follows. With the connection to the umbilical 42 in tact, line B is pressurized, and so the further non-return valve is in its second position (two way flow). The pilot valve 14 remains in its closed position, but pressurized fluid is supplied to actuators 28, 30 of the auxiliary pilot valves 32, 34 via the control line C and the umbilical control line. This fluid is pressurized to such an extent that the auxiliary pilot valves 32, 34 move from their rest positions to their active positions in which the open port 10*a* of the pressure relief valve actuator is connected to the accumulator bottle 12 by the first auxiliary pilot valve 32 and the close port 10*b* of the pressure relief valve actuator is connected to the drain line A via the second auxiliary pilot valve 34. The pressure relief valve 10 therefore moves to its open position. This is illustrated in FIG. 6. The pressure relief valve 10 can be returned to its closed position by exhausting the control line C via the umbilical control line.

If, whilst the control line C is pressurized, the pressure in the riser 1 continues to rise, and rises to such an extent that the pilot valve 14' is moved to its open position, the pressure supplied to the actuators 28, 30 of the auxiliary pilot valves 32, 34 is maintained, and the pressure relief valve 10 remains open.

If the connection to the umbilical 42 (and hence the possibility of surface control) is lost, the pressure relief valve 10 will be opened automatically in the event of riser 1 over-pressure by the pilot valve 14'.

Figure 7:
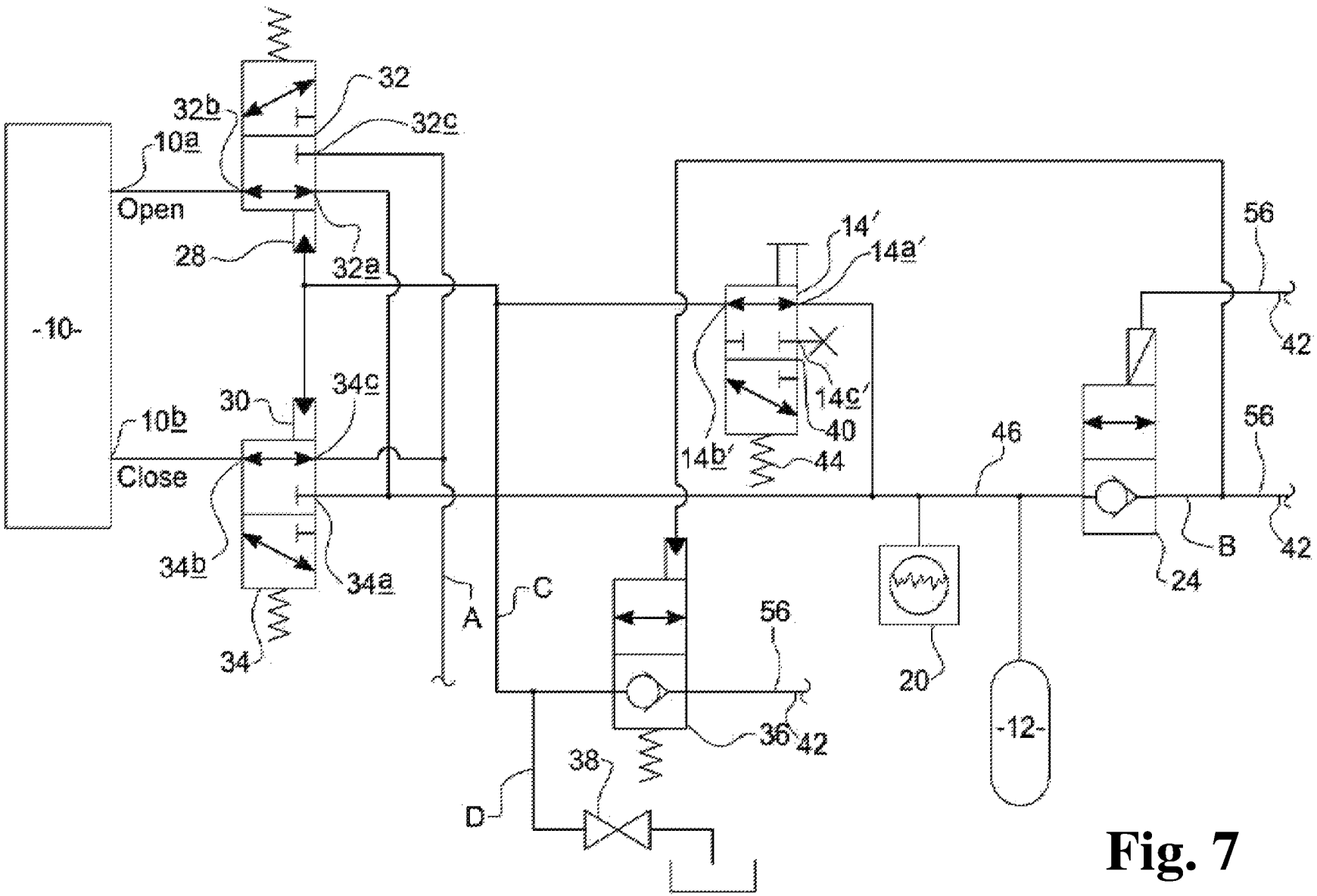
FIG. 7 shows a schematic illustration of the embodiment of the riser pressure relief apparatus illustrated in FIG. 5 in the open position.

In this case, as the pressure in line B upstream of the non-return valve 24 is lost, the further non-return valve 36 moves to its first position in which return flow through the valve 36 is prevented. If the fluid pressure in the riser 1 exceeds the predetermined level, the pilot valve 14' moves to the open position. Fluid flows from the accumulator bottle 12 through the pilot valve 14' to the actuators 28, 30 of the auxiliary pilot valves 32, 34 causing them to move from their rest positions to their active positions. As described above, the further non-return valve 36 is in its first position, and thus retains the pressure in the actuators 28, 30 of the auxiliary pilot valves 32, 34. This fluid is pressurized to such an extent that the auxiliary pilot valves 32, 34 move from their rest positions to their active positions in which the open port 10*a* of the pressure relief valve actuator is connected to the accumulator bottle 12 by the first auxiliary pilot valve 32 and the close port 10*b* of the pressure relief valve actuator is connected to the drain line A via the second auxiliary pilot valve 34. This is illustrated in FIG. 7. The resulting flow of fluid from the accumulator bottle 12 to the open port 10*a* and concomitant exhausting of fluid from the close port 10*b* causes the actuator to move the pressure relief valve 10 from the closed position to the open position. The fluid pressure in the riser 1 may then be relieved by the flow of fluid out of the riser 1 through the side port 6. Fluid flowing through the side port 6 is typically vented to a safe location away from the drilling rig as described in relation to the embodiment shown in FIGS. 1-4.

When the pressure in the riser 1 drops to below the predetermined level, the pilot valve 14' returns to its closed position. The pilot pressure acting on the actuators 28, 30 of the auxiliary pilot valves 32, 34 is, however, trapped by the further non-return valve 36. To release this pilot pressure, an ROV is employed to open the drain valve 38, thus allowing the pilot pressure to drain from the control line C via the pressure release line D. As a result, the auxiliary pilot valves 32, 34 return their rest positions, and the open port 10*a* of the pressure relief valve actuator is connected to the drain line A by the first auxiliary pilot valve 32 and the close port 10*b* of the pressure relief valve actuator is connected to the accumulator 12 via the second auxiliary pilot valve 34. Flow of fluid from the accumulator bottle 12 to the close port 10*b* of the pressure relief valve actuator moves the pressure relief valve 10 from the open position to the closed position. It will be appreciated from the above description that an advantage of the proposed systems is that opening of the pressure relief valve is completely automatic in the event of riser 1 over-pressure. It does not rely on the correct functioning of any electrical or electronic equipment (compared with systems which utilize electrical valves operating based on the reading of an electronic pressure sensor), and cannot be electronically deactivated or overridden by a user accidentally altering the pressure relief set point to a dangerously high level. Even if the system is set up so that the set point for pressure relief can be set electronically (for example, in the embodiment illustrated in FIGS. 1 to 4, by providing for automatic, electronic opening using the electrical control valve 16 based on a reading from a pressure transducer in the riser 1), the pilot valve 14 will always open at the pressure determined by the compressibility of its spring 44, irrespective of what set-point has been set electronically, or, indeed, if the electronic control system is functioning correctly. As such, there is no need to set the system to automatically open the pressure relief valve 10 in the event of an electronic systems failure.

The use of a ball valve 54 as the valve member 48 of the pressure relief valve may be advantageous as such valves can reseal in a reliable fashion without maintenance, parts replacement or retrieval.

Figure 8:
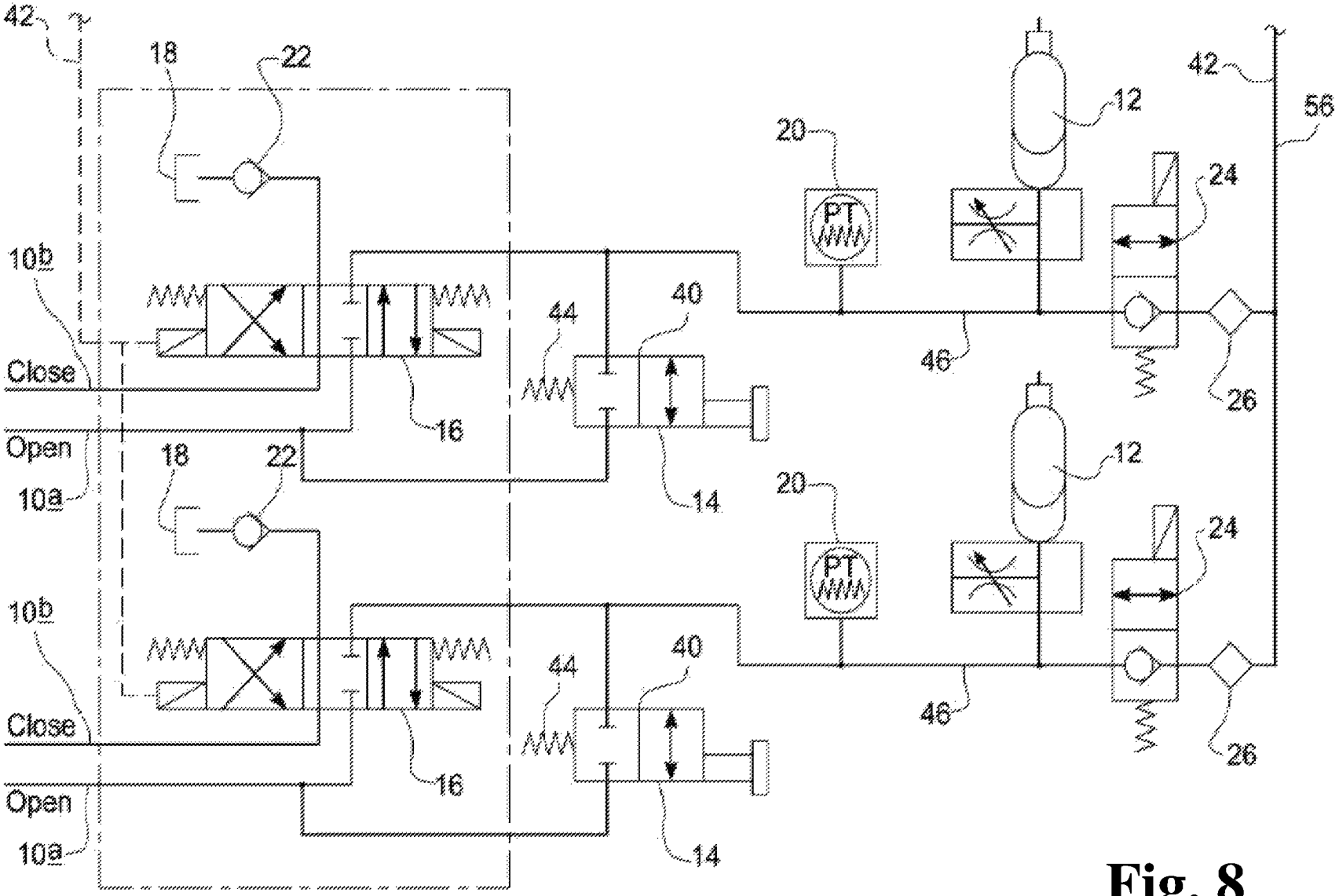
FIG. 8 shows a schematic illustration of a redundant system including the first embodiment of pressure relief apparatus.
Figure 9:
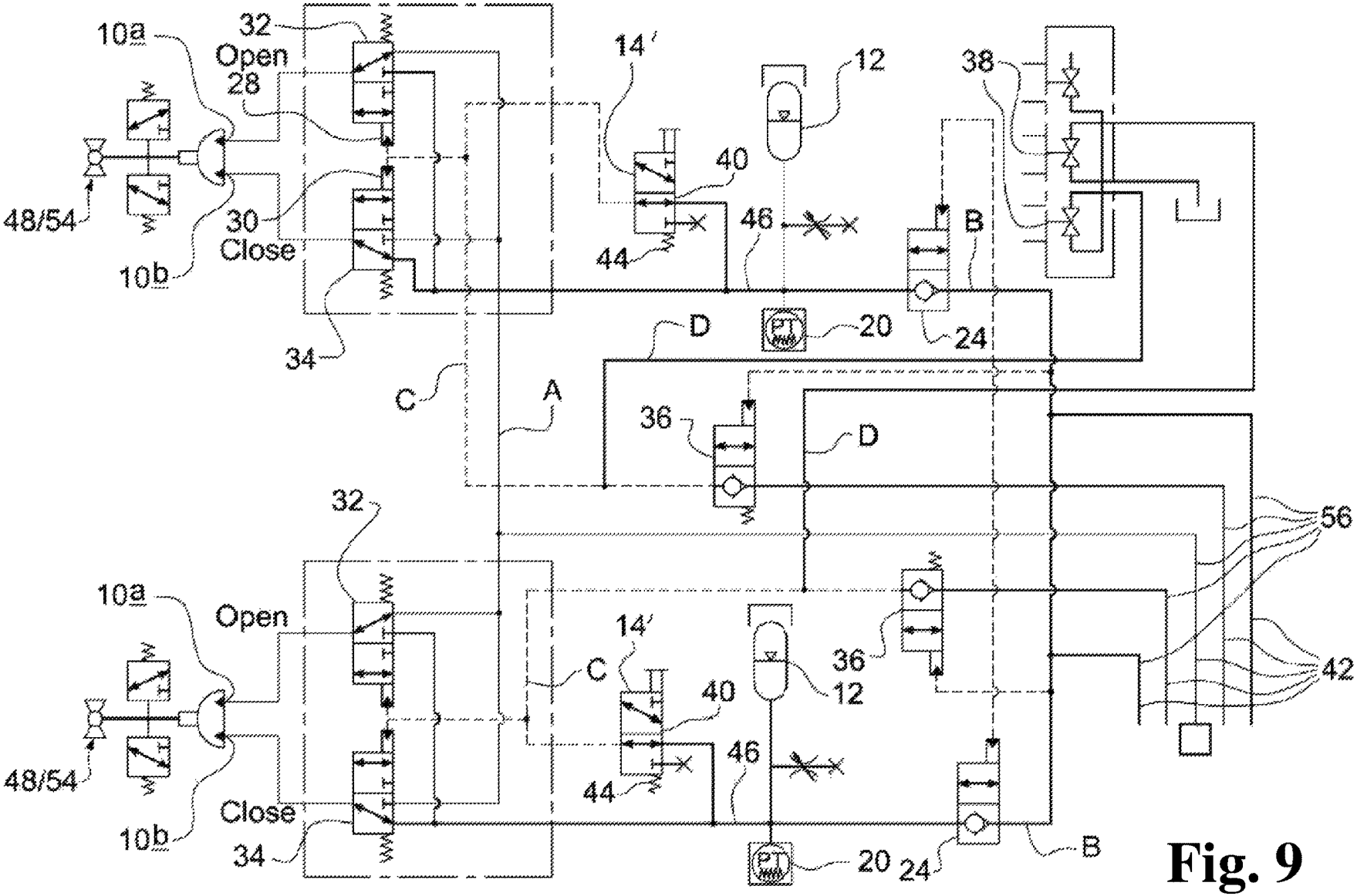
FIG. 9 shows a schematic illustration of a redundant system including the second embodiment of pressure relief apparatus.

Advantageously, the riser 1 will be provided with two identical pressure relief valves 10 and associated control apparatus to provide redundancy should one of the systems fail. Examples of how such redundant systems may be configured are illustrated in FIGS. 8 and 9. FIG. 8 shows a redundant riser pressure relief system including two of the apparatus described above in relation to FIGS. 1 to 4, whilst the system shown in FIG. 9 includes the embodiments described in relation to FIGS. 5 and 6.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the present invention in diverse forms thereof.

The present invention is not limited to embodiments described herein; reference should be had to the appended claims.

What is claimed is:

1. A riser pressure relief apparatus comprising:

a tubular riser comprising a main body which is configured to enclose a main passage, and a side port configured to extend through the main body to connect the main passage with an exterior of the tubular riser; and a pressure relief valve comprising, a valve member which is configured to move between a first position in which the valve member substantially prevents a flow of a fluid through the side port, and a second position in which the flow of the fluid through the side port is permitted, an actuator comprising an open port, the actuator being configured to move the valve member from the first position to the second position via a supply of a pressurized fluid to the open port, a source of the pressurized fluid, and a pilot valve assembly connected to the source of the pressurized fluid, the pilot valve assembly being movable between a first configuration in which a flow of the pressurized fluid from the source of the pressurized fluid to the open port of the actuator is substantially prevented, and a second configuration in which the flow of the pressurized fluid from the source of the pressurized fluid to the open port of the actuator is permitted, the pilot valve assembly comprising a valve part which is fluidly connected to the main passage of the tubular riser, the valve part being configured to move from a first position to a second position when a fluid pressure in the main passage of the tubular riser exceeds a predetermined amount, wherein, a movement of the valve part from the first position to the second position causes the pilot valve assembly to move either from the first configuration to the second configuration or from the second configuration to the first configuration.

2. The riser pressure relief apparatus as recited in claim 1, wherein the valve member is configured to rotate between the first position and the second position.

3. The riser pressure relief apparatus as recited in claim 1, wherein the pressure relief valve is a ball valve.

4. The riser pressure relief apparatus as recited in claim 1, further comprising:

an accumulator bottle, wherein, the accumulator bottle is the source of the pressurized fluid.

5. The riser pressure relief apparatus as recited in claim 1, wherein the source of the pressurized fluid and the pilot valve assembly are arranged adjacent to the pressure relief valve.

6. The riser pressure relief apparatus as recited in claim 1, further comprising;

a connector; and an umbilical, wherein, the source of the pressurized fluid and the pilot valve assembly are arranged downstream of the connector, and the source of the pressurized fluid is connected to the umbilical.

7. The riser pressure relief apparatus as recited in claim 1, wherein the pressurized fluid in the source of pressurized fluid is a hydraulic fluid.

8. The riser pressure relief apparatus as recited in claim 1, wherein the valve part of the pilot valve assembly comprises a piston which comprises a face which is exposed to the fluid pressure in the main passage of the tubular riser.

9. The riser pressure relief apparatus as recited in claim 1, wherein the pilot valve assembly further comprises a resilient biasing element which is configured to exert a force on the valve part so as to urge the valve part into the first position.

10. The riser pressure relief apparatus as recited in claim 1, wherein, the source of the pressurized fluid is a local source of pressurized fluid, and the pressure relief apparatus further comprises a fluid flow line which is configured to connect to a remote source of pressurized fluid.

11. The riser pressure relief apparatus as recited in claim 10, wherein the fluid flow line is configured to extend to the local source of pressurized fluid.

12. The riser pressure relief apparatus as recited in claim 11, further comprising:

a non-return valve arranged in the fluid flow line, the non-return valve being configured to permit the flow of the fluid along the fluid flow line towards the local source of pressurized fluid while preventing the flow of the fluid along the fluid flow line in an opposite direction.

13. The riser pressure relief apparatus as recited in claim 1, wherein, the pilot valve assembly further comprises a control inlet for an external control signal, and the pilot valve assembly is further configured to move from the first configuration to the second configuration upon receipt of the external control signal at the control inlet.

14. The riser pressure relief apparatus as recited in claim 13, wherein the control inlet is configured for an electrical control signal.

15. The riser pressure relief apparatus as recited in claim 13, wherein the control inlet is configured for a fluid pressure control signal.

16. The riser pressure relief apparatus as recited in claim 14, wherein the pilot valve assembly further comprises a pilot valve which comprises the valve part.

17. The riser pressure relief apparatus as recited in claim 16, wherein the pilot valve assembly further comprises a control valve which is configured to move from a rest position, in which the flow of the fluid from the source of the pressurized fluid to the open port of the actuator is substantially prevented, to an active position, in which the flow of the fluid from the source of the pressurized fluid to the open port of the actuator is permitted upon receipt of the external control signal.

18. The riser pressure relief apparatus as recited in claim 17, wherein the control valve comprises an electrically operable actuator which is configured to move the control valve from the rest position to the active position when the electrical control signal is supplied to the electrically operable actuator.

19. The riser pressure relief apparatus as recited in claim 17, wherein the control valve is a pilot operated valve comprising a control valve actuator to which the control inlet is connected, the control valve being further configured so that the control valve moves from the rest position to the active position when a fluid pressure at the control inlet exceeds a predetermined level.

20. The riser pressure relief as recited in claim 17, wherein, the control valve comprises a first port which is connected to the source of the pressurized fluid via a flow line which does not contain the pilot valve, a second port which is connected to the open port via a flow line which does not contain the pilot valve, and a valve member which is movable between a first position in which the flow of the fluid between the first port and the second port is permitted, and a second position in which the flow of the fluid between the first port and the second port is substantially prevented.

21. The riser pressure relief apparatus as recited in claim 20, wherein the control valve is configured to connect the open port of the actuator to the a low pressure region.

22. The riser pressure relief apparatus as recited in claim 21, wherein the control valve is configured to connect the open port of the actuator to the low pressure region when the control valve is in the rest position.

23. The riser pressure relief apparatus as recited in claim 1, wherein, the actuator further comprises a close port, and the actuator is configured so that the valve member of the pressure relief valve is movable from the second position to the first position by the supply of the pressurized fluid to the close port of the actuator.

24. The riser pressure relief apparatus as recited in claim 23, wherein, the actuator is configured so that, if a fluid pressure at the open port exceeds a fluid pressure at the close port by a predetermined amount, the actuator moves the valve member from the first position to the second position, while if the fluid pressure at the close port exceeds the fluid pressure at the open port by the predetermined amount, the actuator moves the valve member from the second position to the first position.

25. The riser pressure relief apparatus as recited in claim 23, wherein the pilot valve assembly is configured to allow the flow of the pressurized fluid from the source of the pressurized fluid to the close port, and to connect the open port of the actuator to a low pressure region when the pilot valve assembly is in the first configuration.

26. The riser pressure relief apparatus as recited in claim 23, wherein the control valve is configured to be movable to a close position in which the close port of the actuator is connected to the source of the pressurized fluid while the open port of the actuator is connected to a low pressure region.

27. The riser pressure relief apparatus as recited in claim 26, wherein the control valve comprises an electrically operable actuator which is configured to move the control valve from the rest position to the close position upon a supply of electrical power to the electrically operable actuator.

* * * * *